US005298576A

United States Patent [19]

Sumida et al.

[11] Patent Number: 5,298,576

[45] Date of Patent: Mar. 29, 1994

[54] SIZING AGENT FOR CARBON FIBER AND CARBON FIBER TREATED WITH SAID SIZING AGENT

[75] Inventors: Atsushi Sumida; Toyokazu Minakuchi; Motoi Itoh, all of Ehime; Itsuki Taniguchi, Kyoto; Hiroshi Hasegawa, Kyoto; Manabu Saito, Kyoto, all of Japan

[73] Assignees: Toray Industries, Inc., Tokyo; Sanyo Chemical Industries, Ltd., Kyoto, both of Japan

[21] Appl. No.: 840,235

[22] Filed: Feb. 24, 1992

[30] Foreign Application Priority Data

Feb. 25, 1991 [JP] Japan ..... 3-30269

[51] Int. Cl.[5] ..... C08F 283/00

[52] U.S. Cl. ..... 525/528; 523/205; 528/93

[58] Field of Search ..... 525/528; 523/205; 528/93

[56] References Cited

U.S. PATENT DOCUMENTS

| | | | |
|---|---|---|---|
| 3,525,779 | 8/1970 | Hawkins et al. | 525/528 |
| 4,420,512 | 12/1983 | Ogawa et al. | 523/205 |
| 4,474,906 | 10/1984 | Nakama et al. | 523/205 |
| 4,496,671 | 1/1985 | Yoshinaga et al. | 523/206 |
| 4,555,446 | 11/1985 | Sumida et al. | 523/427 |
| 4,781,947 | 11/1988 | Saito et al. | 525/455 |
| 5,028,640 | 7/1991 | Shimaoka et al. | 523/205 |

OTHER PUBLICATIONS

"Epikote 834 Technical Manual, EP 1.1.14, 2nd Edition" issued by Shell Chemicals.

*Primary Examiner*—Melvyn I. Marquis
*Assistant Examiner*—Randy Gulakowski
*Attorney, Agent, or Firm*—Nikaido, Marmelstein, Murray & Oram

[57] ABSTRACT

A sizing agent for carbon fibers which comprises, as the indispensable ingredients, an epoxy resin having a viscosity of more than 1,000 P but up to 20,000 P at 50 ° C. and a urethane compound prepared from a polyol having an oxyalkylene unit with a polyisocyanate.

13 Claims, No Drawings

SIZING AGENT FOR CARBON FIBER AND CARBON FIBER TREATED WITH SAID SIZING AGENT

BACKGROUND OF THE INVENTION

The present invention relates to a sizing agent for carbon fibers and the carbon fibers treated with this agent. In particular, the present invention relates to a stable and homegeneous aqueous epoxy resin dispersion and carbon fibers treated with this dispersion and having a high flexibility and excellent moldability and physical properties.

Since, in general, an epoxy resin is widely used as a matrix resin of carbon fiber reinforced composite materials, the epoxy resin itself has been often used also as the sizing agent for carbon fibers. It was generally difficult to disperse the epoxy resin in water to form a stable and homogeneous dispersion in the prior art, since this resin is generally hydrophobic. Therefore, in an earlier stage of the industrialization of the technique of producing carbon fibers, a solution of the resin in an organic solvent such as methyl ethyl ketone was used, as such, as the sizing agent. Since, however, organic solvents are apt to cause fire hazard and are toxic, it has been eagerly demanded to provide an aqueous dispersion of the epoxy resin from the viewpoint of safety and hygiene.

As for the process for dispersing the epoxy resin in water, Japanese patent application Kokai publication No. 57-171767 proposed a process which comprises adding a diglycidyl ether/bisphenol A epoxy resin and a resin composition containing other epoxy resin which is solid at room temperature to water. Unfavorably, however, carbon fibers treated with this aqueous epoxy resin dispersion containing an epoxy resin of a viscosty as low as about 10 to $10^3$ poise (at 50 ° C.) were apt to be opened by a strong friction in the winding and unwinding steps and a molding process of a filament winding to undergo fluffing and yarn breakage to thereby impair their physical properties, because of the above epoxy resin have a viscosity of as low as about 10 to 1000 poise at 50 ° C. When the viscosity of this dispersion was increased, the stability of the dispersion was reduced correspondingly and uniform application of the dispersion to the carbon fibers became difficult unfavorably.

Japanese patent application Kokai publication No. 58-13781 proposed an aqueous dispersion containing a quaternary ammonium base-containing polyurethane resin and an epoxy to be used as the sizing agent for carbon fibers. However, since the sized carbon fibers with this dispersion are rather hard, soft-typed sizing agent is desired especially in a croth-making use.

U.S. Pat. No. 4,474,906 disclosed a high molecular weight completely theremoplastic polyurethane resin as the sizing agent for treating carbon fibers. However, this sizing agent has a drawback of impairing a working environment because of being in use by dissolving it an organic solvent.

Further, some of plastics reinforced by the carbon fiber treated with the sizing agent has an unsatisfactory mechanical property, because the agent is poorly compatible with a thermosetting matrix resin such as cured epoxy resin and has no reactive group with the matrix resin.

BRIEF SUMMARY OF THE INVENTION

An object of the present invention is to provide a stable and homogeneous aqueous dispersion of an epoxy resin usable as a sizing agent for carbon fibers, which is free from the problems of safety and hygiene and which does not stiffen the carbon fibers. Another object of the present invention is to provide carbon fibers having excellent moldability and physical properties, which can be molded by filament winding and which are prevented from being opened to undergo fluffing or yarn breakage even by a strong friction in the winding and unwinding steps.

The objects of the present invention can be attained by a sizing agent for carbon fibers which comprises, as the indispensable ingredients, an epoxy resin having a viscosity of more than 1,000 P but up to 20,000 P at 50 ° C. and a urethane compound having at least two hydroxyl groups prepared from a polyol having an okyalkylene unit and a polyisocyanate, and carbon fibers treated with this sizing agent.

A viscosity of the epoxy resin in the present invention is a value measured by using a Bookfield viscomer (rotor No.4 to 7) under the conditions of 2 r.p.m and 50 ° C.

DETAILED DESCRIPTION OF THE INVENTION

The epoxy resins usable in the present invention include those described on pages 1-1 to 3-20 of Henry's Handbook of Epoxy Resins published by McGraw-Hill Brook Company in 1967. Specifically, they include:

phenolic glycidylether epoxy resins such as bisphenol A epoxy resin, halogenated bisphenol A epoxy resin, bisphenol AD epoxy resin, bisphenol F epoxy resin, phenol-novolak epoxy resin, halogenated phenol-novolak epoxy resin, cresol-novolak epoxy resin;

aromatic glycidylamine epoxy resins such as condensates of aromatic polyamines such as aniline, diaminodiphenylmethane, o-,p-,m-aminophenol, 2-amino-p-cresol, 6-amino-p-cresol, o-,p-,m-xylylenediamine, o-,m-,p-chloroaniline, o-,m-,p-bromoaniline, o-,m-,p-iodoaniline, bisaminomethylcyclohexane with epichlorohydrin;

alicyclic epoxy resins such as bis-(3,4-epoxy-6-methyl cyclohexyl) adipate, 3,4-epoxycyclohexylmethyl-3,4-epoxycyclohexane carboxylate, 2-(3,4-epoxy)-cyclohexyl-5,1-spiro-(3,4-epoxy)-cyclohexyl-m-dioxane, and a hydrogenated nucleous compound of the glycidylated phenols above mentioned;

aliphatic ether epoxy resins such as condensates of aliphatic polyhydric alcohols or polyetherpolyols with epichlorohydrin;

ester epoxy resins such as copolymers of glycidyl(-meth)acryrate with an ethylenically unsaturated monomer e.g. acrylonitril, hydroxy(meth)acrylate, N,N'-dimethylaminoethyl(meth)acrylate;

epoxy resins such as epoxidate soybean oil; Those having the viscosity of more than 1000 poise but up to 20,000 poise at 50 ° C. are selected.

Among them, the phenolic glycidylether epoxy resins and the aromatic glycidylamine epoxy resins, particularly the former, are preferably used.

The urethane compound to be used in the present invention is derived by reacting a polyol having an oxyalkylene unit with a polyisocyanate A typical polyol is an alkyleneoxide adduct of a compound having at least two active hydrogens.

The polyols can be used either of polyether polyol or polyester polyol. A molecular weight of the polyol is usually in the range of 500 to 50,000, preferably 500 to 30,000, more preferably 500 to 10,000.

The compounds containing at least two active hydrogen atom include: aliphatic dihydric alcohols such as ethyleneglycol, propyleneglycol, 1,4-butane diol, 1,3-butanediol, aliphatic trihydric and higher hydric alcohols such as glycerin, tri-methylolpropane, pentaerythritol and sucrose;

polyhydric phenols such as bisphenol A, pyrogallol, hydroquinone, condensates of phenols with formaldehyde described in U.S. Pat. No. 3,265,641;

polyamine such as hydric polyamines, e.g., triethanolamine, N-methyl diethanolamine and monoethanolamine; aliphatic polyamines e.g., ethylene diamine, diethylene triamine, triethylene tetramine; and aromatic amine e.g., tolylenediamine, methylenedianiline and polymethylenepolyphenylene diamines;

polycarboxylic acids such as aliphatic polycarboxylic acids, e.g., succinic acid, adipic acid, sebacic acid, maleic acid and dimer acid; and aromatic polycarboxylic acids, i.e., phthalic acid, terephthalic acid and trimellitic acid. Among them, the polyhydric alcohols and amines, particularly the former, are preferred.

The oxyalkylene unit include those having 2 to 4 carbon atoms, such as oxyethylene unit (EO), oxypropylene unit (PO), oxybutylene unit (BO) and mixtures of two or more of them. The oxyalkylene units can be used in combination of two or more of them. The oxyalkylene unit may be either random or block, oxyethylene unit (EO) and oxypropylene unit (PO) are preferred. Still preferred are block units containing at least 10% by weight, based on the total of oxyethylene unit (EO) and oxypropylene unit (PO), of oxyethylene unit (EO).

The polyisocyanates includes:

aromatic polyisocyanates such as those having 4 to 100 caron atoms, e.g., 2,4-tolylene diisocyanate, 2,6-tolylene diisocyanate, xylylene diisocyanate, tetramethylxylylene diisocyanate,diphenylmethane 4,4'-diisocyanate (MDI), and MDI (phosgenated product of crude MDI composed of a mixture of condensate product of formaldehyde with aromatic amine such as aniline or diaminodiphenylmethane and minor amount (5 to 20% by weight) of polyamine having at least three functional group), 1,3-bis(phenylmethyl)benzene 4,4',4''-triisocyanate and naphthylene diisocyanate;

aliphatic polyisocyanates such as ethylene diisocyanate, tetramethylene diisocyanate, hexamethylene diisocyanate, dodecamethylene diisocyanate, 1,6,11-undecamethylenediisocyanate, 2,2,4-trimethylhexane diisocyanate, lysine diisocyanate, methyl 2,6-diisocyanatocaproate, bis(2-isocyanato ethyl)fumarate, bis(2-isocyanato ethyl) carbonate and 2-isocyanatoethyl 2,6-diisocyanatohexanate; and alicyclic polyisocyanates such as isophorone diisocyanate, cyclohexane 1,4-diisocyanate and 1,4-methylenebis(cyclohexyl isocyanate). They can be used either singly or in combination of two or more of them. Among them, preferred are the aromatic polyisocyanates.

Preferred urethane compounds in the present invention are those having an equivalent ratio (OH/NCO) of the polyol adduct to the polyisocyanate of 3:1 to 1:1, preferably 3:1.06 to 1:1, more preferably 2.2:1 to 1.8:1. When the equivalent ratio is 1 or above, no free isocyanate group is formed in the urethane compound to make the preparation of a stable aqueous dispersion of the epoxy resin possible.

The urethane compounds can be synthesized by any known process. A process wherein the polyol having the oxyalkylene unit is reacted with the polyisocyanate at a temperature of 40° to 150 ° C., preferably 60° to 100 ° C., is usually desirable. When a polyol having a nitrogen atom is used as the polyol, the reaction temperature is 80 ° C. or below, preferably 0° to 70 ° C. The reaction can be conducted in either the presence or absence of an organic solvent. The organic solvents usable herein include ketones such as acetone, methyl ethyl ketone and isobutyl ketone; esters such as ethyl acetate and butyl acetate; ethers such as dioxane and tetrahydrofuran; aromatic hydrocarbons such as toluene and xylene; amides such as dimethylformamide and dimethylacetamide; sulfoxides such as dimethyl sulfoxide, and mixtures of two or more of these solvents. Among them, preferred are acetone, methyl ethyl ketone, ethyl acetate, butyl acetate, tetrahydrofuran, toluene, xylene, and a mixture of two or more of these solvents.

The above urethane compound can be synthesized in either the presence or absence of catalyst. The catalysts usable herein include polyamines such as triethylamine, N-ethylmorpholine, triethylenediamine etc; and organotin-compounds such as dibutyltin-dilaurate and dioctyltin-dilaurate etc.

The obtained urethane compounds because of having a high dispersibility in water has a function of easily dispersing the highly viscous epoxy resin in water to form a stable dispersion.

The aqueous dispersion of sizing agent for carbon fibers of the present invention can be produced by adding the epoxy resin and urethane compound in solution or bulk in water. The dispersion can be also produced by adding a water-soluble organic solvent to at least one effective impredient before or after the dispersion in water and, if desired, emulsifying it by heating the mixture. The water-soluble organic solvents include alcohols such as methanol, ethanol, isopropanol, ethylene glycol, diethylene glycol and glycerol; ethers such as tetrahydrofuran, dioxane, ethylene glycol dimethyl ether and ethylene glycol diethyl ether; ketones such as acetone and methyl ethyl ketone; and esters such as methyl acetate and ethyl acetate.

The ratio of the urethane compound to the epoxy resin in the sizing agent of the present invention ranges from 1 to 100% by weight, preferably 10 to 40% by weight, based on the epoxy resin. When it is less than 1% by weight, no aqueous dispersion having a sufficient stability can be obtained. On the contrary, when it exceeds 100% by weight, the relative amount of the epoxy resin is reduced to impair the properties of the sizing agent. From the viewpoint of economization and facilitaion of the dispersion, the solid concentration of the solution containing the sizing agent in the present invention is preferably in the range of 30 to 70% by weight. It can be suitably diluted with water before use.

The amount of the sizing agent to be applied to the carbon fiber is usually from 0.1 to 10% by weight on the basis of the solid concentration, preferably 0.3 to 5.0% by weight. When it is less than 0.1% by weight, the bundling effect is insufficient and the fluffing is liable to occur. On the contrary, when it exceeds 10% by weight, the filaments become too stiff to impair the composite properties. The sizing agent can be applied to the carbon fiber by the impregnation method using a dip roller, the kiss-roll method wherein it is brought into contact with a rotating roller, or the spray method.

After the application of the sizing agent in the present invention, the carbon fiber is dried by heat treatment at 100° to 250 ° C. When the temperature is below 100 ° C., the evaporation velocity of water is low and therefore a long drying time and, therefore, a long dryer are necessitated, which are economically disadvantagepus. On the contrary, when the temperature is above 250 ° C., the sizing agent is denatured by heat unfavorably. Suitable drying methods include hot air drying method, infrared drying method and hot roller contact method.

According to the present invention wherein the epoxy resin having a high viscosity is stably dispersed in water by using the urethane compound to form an aqueous dispersion resulted in a sizing agent usable in the production of carbon fibers can be obtained. Since the resin component contained in the sizing agent has an excellent adhesion to the carbon fibers, the treated carbon fibers are not opened even by a strong friction in the winding and unwinding steps and, therefore, they are free from fluffing and yarn breakage. Namely, they have excellent unwindability and friction resistance. Since the carbon fibers treated with the sizing agent of the present invention have excellent flexibility, moldability and physical properties, they can be molded by filament winding.

EXAMPLE 1

40 parts of each of epoxy resins [A-1] to [A-3] comprising a mixture of Epikote 828 and Epikote 1001 in a varied ratio and having a viscosity (P) at 50 ° C. as specified in Table 1 (products of Yuka Shell Epoxy K.K.) and 10 parts of a urethane compound [B-1]prepared from 2 mol of PO/EO block adduct of propylene glycol (average molecular weight: 8,000; molar ratio of oxypropylene unit to oxyethylene unit: 1:5) and 1 mol of tolylene diisocyanate (TDI) were fed in a high-viscosity emulsification apparatus and homogeneously mixed with one another under heating a 60° to 90 ° C. 10 parts of water was added thereto and thoroughly mixed therewith to conduct emulsification and phase inversion. After the completion of the phase inversion, 40 parts of water was slowly added thereto to obtain a sizing agent [1], [2] or [3] in a homogeneous white emulsion form.

Dispersion stability of the sizing agent is evaluated by the following method, and this results is shown in Table 1.

Stability of Aqueous Dispersion 25 ml of the sizing agent having a resin content of 5% by weight is put in a 50-ml glass centrifugal precipitation tube. After the centrifugation in a centrigual separator at 4,000 rpm for 10 min, the supernatant liquid is removed by decantation and the precipitate at the bottom of the tube is dissolved in methyl ethyl ketone. The solution is transferred into a Petri dish and evaporated to dryness. The product is weighed. When it was 50 mg or less, the stability of the aqueous dispersion of the sizing agent is judged as satisfactory.

EXAMPLE 2

Sizing agents [4] and [5] were prepared from the epoxy resin [A-2] used in the Example 1 and a urethane compound [B-2] or [B-3] having a molar ratio of the PO/EO block adduct of propylene glycol to TDI varied in the range of 3:1 to 1:1 as specified in the Table 1 in the same manner as that of the Example 1. The stability of each of the aqueous dispersion of the sizing agents thus obtained is given in this table. Example 3:

Sizing agents [6], [7] and [8] were produced in the same manner as that of the Example 1 except that the weight ratio of the epoxy resin [A-2]to the urethane compound [B-1] was altered to 100:1 to 50:50. The stability of each of the aqueous dispersions of the sizing agents thus obtained is given in the Table 1.

EXAMPLE 4, 5, 6

Sizing agents [9], [10] and [11] were produced in the same manner as that of the Example 1 except that the urethane compounds were altered to the urethane compounds [C-1], [C-2] and [C-3] in the Table 2 synthesized by using the MDI, hexamethylene-diisocyanate (HDI) and isophorone-diisocyanate, respectively.

The stability of each of the aqueous dispersions of the sizing agents [9], [10] and [11] thus obtained is given in Table 1.

EXAMPLES 7, 8, 9

Sizing agents [12], [13] and [14] were produced in the same manner as that of the Example 1 except that the urethane compounds were altered to the urethane compounds [D-1], [D-2] and [D-3] in the Table 2 synthesized by using the polyols having a molecular weight and a molar ratio of the PO/EO shown in Table 2, respectively.

The stability of each of the aqueous dispersions of the sizing agents [12], [13] and [14] thus obtained is given in Table 1.

EXAMPLES 10, 11

Sizing agents [15] and [16] were produced in the same manner as that of the Example 1 except that the epoxy resins were employed to the epoxy resins [A-4] having 20,000 poise of a viscosity at 50 ° C. and [D-5] having 10,000 poise of a viscosity at 50 ° C. containing the Epikote 828 and Epikote 1001 in a varied ratio in the Table 1, respectively.

The stability of each of the aqueous dispersions of the sizing agents [15] and [16] thus obtained is given in Table 1.

TABLE 1

| | | epoxy resin | | urethane compound | | wt. ratio of | |
|---|---|---|---|---|---|---|---|
| | sizing agent | kind | viscosity [P] | kind | molar ratio of block adduct to TDI | epoxy resin to urethane compound | aqueous dispersion stability (mg) |
| Ex. 1 | [1] | A-1 | 5,000 | B-1 | 2:1 | 80:20 | 20 |
| | [2] | A-2 | 3,000 | B-1 | 2:1 | 80:20 | 15 |
| | [3] | A-3 | 1,000 | B-1 | 2:1 | 80:20 | 10 |
| Ex. 2 | [4] | A-2 | 3,000 | B-2 | 3:1 | 80:20 | 40 |
| | [2] | A-2 | 3,000 | B-1 | 2:1 | 80:20 | 15 |
| | [5] | A-2 | 3,000 | B-3 | 1:1 | 80:20 | 45 |
| Ex. 3 | [6] | A-2 | 3,000 | B-1 | 2:1 | 100:1 | 50 |
| | [7] | A-2 | 3,000 | B-1 | 2:1 | 90:10 | 25 |

TABLE 1-continued

| | sizing agent | epoxy resin kind | epoxy resin viscosity [P] | urethane compound kind | urethane compound molar ratio of block adduct to TDI | wt. ratio of epoxy resin to urethane compound | aqueous dispersion stability (mg) |
|---|---|---|---|---|---|---|---|
| | [2] | A-2 | 3,000 | B-1 | 2:1 | 80:20 | 15 |
| | [8] | A-2 | 3,000 | B-1 | 2:1 | 50:50 | 10 |
| Ex. 4 | [9] | A-2 | 3,000 | C-1 | 2:1 | 80:20 | 23 |
| Ex. 5 | [10] | A-2 | 3,000 | C-2 | 2:1 | 80:20 | 18 |
| Ex. 6 | [11] | A-2 | 3,000 | C-3 | 2:1 | 80:20 | 20 |
| Ex. 7 | [12] | A-2 | 3,000 | D-1 | 2:1 | 80:20 | 40 |
| Ex. 8 | [13] | A-2 | 3,000 | D-2 | 2:1 | 80:20 | 10 |
| Ex. 9 | [14] | A-2 | 3,000 | D-3 | 2:1 | 80:20 | 5 |
| Ex. 10 | [15] | A-4 | 20,000 | B-1 | 2:1 | 80:20 | 30 |
| Ex. 11 | [16] | A-5 | 10,000 | B-1 | 2:1 | 80:20 | 25 |
| Comp. | [BG-1] | A-6 | 500 | B-1 | 2:1 | 80:20 | 10 |
| Ex. | [BG-2] | A-7 | 100 | B-1 | 2:1 | 80:20 | 5 |

EXAMPLE 12

Each of the sizing agents [1] through [8] obtained in the Examples 1 to 3 was diluted with water to prepare sizing agents <1> through <8> having a concentration of 3% (the numbers of the sizing agents [1] to [8] before the dilution correspond to the sizing agents <1> to <8>, respectively). A bundle of carbon fibers "Torayca" (trade name) T300-12K (a product of Toray Industries, Inc.) comprising 12,000 filaments was immersed in the sizing agent to impregnate the former with the latter. After drying with hot air at 180 ° C. for 2 min, the fibers were wound round a bobbin. The amount of the sizing agent adherent to the carbon fiber, the windability and friction resistance of the carbon fibers wound round the bobbin, the stiffness of the filaments, and composite properties were examined to obtain the results given in Table 2.

TABLE 2

| Kind of urethane compound | Kind of polyisocyanate | Molecular weight of polyol | Molar ratio of EO/PO in polyol | Molar ratio of polyol to polyisocyanate |
|---|---|---|---|---|
| C-1 | MDI | 8,000 | 1/5 | 2:1 |
| C-2 | HDI | 8,000 | 1/5 | 2:1 |
| C-3 | IPDI | 8,000 | 1/5 | 2:1 |
| D-1 | TDI | 1,000 | 1/5 | 2:1 |
| D-2 | TDI | 40,000 | 1/5 | 2:1 |
| D-3 | TDI | 8,000 | 1/1 | 2:1 |

The unwindability and friction resistance of the carbon fibers to which the sizing agent, the stiffness of the filaments, and composite properties were determined by the following method:

Unwindability

The unwindability is expressed by the number of times of yarn breakage per $10^5$ of the overall test length wherein the carbon fiber wound round a bobbin was unwond at a rate of 50 m/min. The number of times of yarn breakage is preferably 10 or less.

Friction Resistance

Five stainless steel rods each having a smooth surface and a diameter of 10 mm are arranged in zigzags and in parallel at a distance of 50 mm from each other so that the carbon fiber filaments will pass between them in contact with them at an angle of 120°. Carbon fiber filaments (fineness: 12,000 D; filament no.: 12,000 in terms of raw yarn) are passed through the apparatus at a rate of 3 m/min while applying an initial tension of 300 g thereto, and exposed to laser beams at right angles. The number of fluffs formed is counted from the number of times of shading the laser beams and expressed by the number of fluffs / m. It is preferably 50/m or below.

Stiffness of Filament 12,000 carbon fiber filaments having a test length of 10 cm are twisted 10 times and the resulting torque is transmitted to a stainless steel wire having a length of 20 cm and a thickness of 0.3 mm. The stiffness of the filament is expressed by the angle of twist of the wire. The angle of twist is preferably 30° or below.

Composite Properties

The carbon fibers are doubled in one direction and put in a mold. They are impregnated with a resin comprising 100 parts of Epikote 828 and 3 parts of $BF_3MEA$ in a vacuum. In this step, the amount of the carbon fibers is controlled so that the volume of the fibers will be 60%. After the completion of the impregnation, the fibers are cured at 150 ° C. under pressure for 1 h, taken out of the mold, and post-cured at 140 ° C. for 4 h.

The tensile strength (TS) of each test piece having a thickness of 2.5 mm and a width of 6.0 mm is determined according to ASTM D-3039-72-T and the interlaminar shear strength thereof (ILSS) is determined according to ASTM D-2344.

EXAMPLES 13–20

Each of the sizing agents [9] through [16] was diluted with water to prepare the aqueous dispersions <9> through <16> (corresponding to the number of the sizing agents [9] through [16]) obtained by the Examples 4–11, respectively.

A bundle carbon fibers "Torayca" T300-12K was treated in the same manner as that of the Example 1 except that each of the above aqueous dispersions <9> through <16> was employed, respectively. The obtained carbon fibers were wound around the bobbin. The amount of the adherent sizing agent, the unwindability and friction resistance of the carbon fibers, the stiffness of the filaments, and composite properties were examined to obtain the results given in Table 3.

Comparative Example

Sizing agents [BG-1] and [BG-2] were produced from epoxy resins [A-6] and [A-7] having a molar ratio of Epikote 828 to Epikote 1001 (products of Yuka Shell Epoxy K.K.) varied so that the viscosity at 50 ° C. would be 100 P and 500 P, respectively, in the same manner as that of the Example 1. The stability of each of the aqueous dispersions of the sizing agents thus obtained is given in the Table 1.

A bundle of carbon fibers "Torayca" (trade name of Toray Industries, Inc.) T300-12K was wound round a bobbin in the same manner as that of the Example 12 except that sizing agent [9] or the aqueous dispersions [17], [18] having a concentration of 3% prepared from sizing agents [BG-1] or [BG-2] was used and that the drying temperature was altered to 120 ° C. and the amount of the adherent sizing agent, the unwindability and friction resistance of the carbon fibers, the stiffness of the filaments, and composite properties were examined to obtain the results given in the Table 3.

TABLE 3

| | aqueous dispersion | amount of adhesion (%) | unwindability (time/$10^5$ m) | friction resistance (number/m) | stiffness of filament (°) | composite properties TS ($kg/mm^2$) | ILSS ($kg/mm^2$) |
|---|---|---|---|---|---|---|---|
| Ex. 12 | <1> | 1.1 | 2 | 5 | 20 | 180 | 9.0 |
| | <2> | 1.0 | 3 | 7 | 14 | 180 | 8.9 |
| | <3> | 0.9 | 2 | 50 | 12 | 175 | 8.8 |
| | <4> | 1.0 | 4 | 10 | 13 | 175 | 8.7 |
| | <2> | 1.0 | 3 | 7 | 14 | 180 | 8.9 |
| | <5> | 1.1 | 5 | 8 | 16 | 170 | 8.7 |
| | <6> | 1.2 | 4 | 15 | 18 | 185 | 8.8 |
| | <7> | 1.0 | 4 | 7 | 16 | 180 | 9.0 |
| | <2> | 1.0 | 3 | 7 | 14 | 180 | 8.9 |
| | <8> | 0.9 | 4 | 50 | 12 | 170 | 8.6 |
| Ex. 13 | <9> | 1.1 | 2 | 5 | 21 | 180 | 9.0 |
| Ex. 14 | <10> | 1.0 | 3 | 6 | 18 | 175 | 8.8 |
| Ex. 15 | <11> | 1.0 | 2 | 5 | 20 | 185 | 8.9 |
| Ex. 16 | <12> | 1.1 | 2 | 4 | 20 | 185 | 9.0 |
| Ex. 17 | <13> | 0.9 | 4 | 10 | 14 | 175 | 8.7 |
| Ex. 18 | <14> | 1.1 | 3 | 6 | 16 | 170 | 8.6 |
| Ex. 19 | <15> | 1.1 | 3 | 3 | 25 | 180 | 8.9 |
| Ex. 20 | <16> | 1.0 | 2 | 5 | 23 | 175 | 9.0 |
| Comp. | <13> | 1.2 | 4 | 120 | 9 | 170 | 8.9 |
| Ex. | <14> | 1.0 | 3 | 220 | 8 | 175 | 9.0 |

EXAMPLE 21

Sizing agents <2-1>, <2>, <2-2> and <2-3> having a solid concentration of 0.1 to 20% as specified in Table 4 were prepared from the sizing agent [2] prepared in the Example 1. Then the carbon fibers "Torayca" (trade name of Toray Industries, Inc.) T300-12K were wound round a bobbin in the same manner as that of the Examples 13–20 except that the above sizing agents were used. The amount of the sizing agent adherent to the carbon fibers, the windability and friction resistance of the carbon fibers, the stiffness of the filaments, and composite properties were examined to obtain the results given in the Table 4.

TABLE 4

| aqueous dispersion | concentration of dispersion (%) | amount of adhesion (%) | unwindability (time/$10^5$ m) | friction resistance (number/m) | stiffness of filament (°) | composite properties TS ($kg/mm^2$) | ILSS ($kg/mm^2$) |
|---|---|---|---|---|---|---|---|
| <2-1> | 1.0 | 0.3 | 4 | 40 | 10 | 180 | 8.7 |
| <2> | 3.0 | 1.0 | 3 | 7 | 14 | 180 | 8.9 |
| <2-2> | 10.0 | 3.2 | 4 | 6 | 20 | 175 | 8.6 |
| <2-3> | 20.0 | 7.3 | 6 | 6 | 35 | 165 | 8.2 |

What is claimed:

1. A sizing agent for carbon fibers which comprises, as the indispensable ingredients, an epoxy resin having a viscosity of more than 1,000 P but up to 20,000 P at 50 ° C. and a urethane compound having a hydroxyl group prepared from a polyol having an oxyalkylene unit with a polyisocyanate, wherein the amount of urethane is 1 to 100% by weight based on the epoxy resin.

2. A sizing agent for carbon fibers according to claim 1, wherein the epoxy resin is a glycidylated compound of phenoles.

3. A sizing agent for carbon fibers according to claim 2, wherein the phenolic glycidyl epoxy resin is at least one the glycidylated compound is selected from the group consisting of bisphenol A epoxy resin, halogenated bisphenol A epoxy resin, bisphenol AD epoxy resin, bisphenol F epoxy resin, phenol novolack epoxy resin, halogenated phenol novolack epoxy resin.

4. A sizing agent for carbon fibers according to claim 1, wherein the polyol is an alkyleneoxide adduct of a polyhydric alcohol.

5. A sizing agent for carbon fibers according to claim 1, wherein an average molecular weight of the polyol is within a range of 500 is 50,000.

6. A sizing agent for carbon fibers according to claim 1, wherein the oxyalkylene unit of the polyol has 2 to 4 carbon atoms.

7. A sizing agent for carbon fibers according to claim 1, wherein the oxyalkylene unit is at least one kind of an oxyethylene unit and an oxypropylene unit.

8. A sizing agent for carbon fibers according to claim 1, wherein the polyol has at least 10% by weight of the oxyethylene unit.

9. A sizing agent for carbon fibers according to claim 1, wherein the polyisocyanate is an aromatic polyisocyanate.

10. A sizing agent for carbon fibers according to claim 9, wherein the aromatic polyisocyanate is at least one compound selected from the group constituting 2,4-tolylene diisocyanate, 2,6-tolylene diisocyanate, xylylene diisocyanate, tetramethylene diisocyanate, diphenylmethane 4,4-diisocyanate (MDI), 1,3-bis(-phenylmethyl)benzene 4,4',4''-triisocyanate and naphthylene diisocyanate.

11. A sizing agent for carbon fibers according to claim 1, wherein the equivalent ratio of the polyol to the polyisocyanate is in range of 3:1 to 1:1.

12. A sizing agent for carbon fibers according to claim 1, wherein the amount of the urethane compound is 10 to 40% by weight based on the epoxy resin.

13. A sizing agent according to claim 1, wherein the sizing agent is an aqueous dispersion produced by adding the epoxy resin and the urethane compound in bulk in water.

* * * * *